US009931858B2

(12) United States Patent
Ueda

(10) Patent No.: US 9,931,858 B2
(45) Date of Patent: Apr. 3, 2018

(54) SELF-WEIGHT PRESSURE CONTROL VALVE, LIQUID SUPPLY SYSTEM INCLUDING THE SAME, AND INKJET RECORDING DEVICE

(71) Applicant: Roland DG Corporation, Hamamatsu-shi, Shizuoka (JP)

(72) Inventor: Naoki Ueda, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/248,212

(22) Filed: Aug. 26, 2016

(65) Prior Publication Data

US 2017/0057242 A1 Mar. 2, 2017

(30) Foreign Application Priority Data

Aug. 28, 2015 (JP) ..... 2015-169127

(51) Int. Cl.
*B41J 2/175* (2006.01)

(52) U.S. Cl.
CPC ..... *B41J 2/17596* (2013.01); *B41J 2/175* (2013.01); *B41J 2/17509* (2013.01)

(58) Field of Classification Search
None
See application file for complete search history.

(56) References Cited

U.S. PATENT DOCUMENTS

2005/0073559 A1* 4/2005 Aruga ..... B41J 2/17509 347/85
2011/0164077 A1* 7/2011 Masunaga ..... B41J 2/175 347/6

(Continued)

FOREIGN PATENT DOCUMENTS

JP 2005-233298 A 9/2005
JP 2009-210008 A 9/2009
JP 2012-056277 A 3/2012

(Continued)

OTHER PUBLICATIONS

Ueda, "Self-weight pressure control valve, liquid supply system including the same, and inkjet recording device", U.S. Appl. No. 15/393,303, filed Dec. 29, 2016.

*Primary Examiner* — Matthew Luu
*Assistant Examiner* — Tracey McMillion
(74) *Attorney, Agent, or Firm* — Keating & Bennett, LLP

(57) ABSTRACT

A self-weight pressure control valve includes a hollow case main body with an opening, a partitioning wall dividing the case main body into first and second pressure chambers in communication with the opening, a communication opening in the partitioning wall and communicating the first pressure chamber and the second pressure chamber to each other, a valve rod including a rod portion inserted through the communication opening to pass the partitioning wall, and a valve portion located in the first pressure chamber, and a pressure sensitive film covering the opening of the case main body, coupled with a tip of the rod portion of the valve rod, and flexibly deformable toward the rod portion. When the pressure sensitive film is not flexibly deformed toward the rod portion, the communication opening is maintained in a closed state by the valve portion by use of a self-weight of the valve rod.

6 Claims, 8 Drawing Sheets

(56) References Cited

U.S. PATENT DOCUMENTS

| | | | | |
|---|---|---|---|---|
| 2013/0010037 | A1* | 1/2013 | Yokoyama | B41J 2/175 347/85 |
| 2013/0021416 | A1* | 1/2013 | Yokoyama | B41J 2/175 347/85 |

FOREIGN PATENT DOCUMENTS

| | | | | |
|---|---|---|---|---|
| WO | 0339770 | A2 * | 11/1989 | B41J 2/17596 |
| WO | 03/041964 | A1 | 5/2003 | |

* cited by examiner

SELF-WEIGHT PRESSURE CONTROL VALVE, LIQUID SUPPLY SYSTEM INCLUDING THE SAME, AND INKJET RECORDING DEVICE

CROSS REFERENCE TO RELATED APPLICATIONS

The present application claims priority to Japanese Patent Application No. 2015-169127 filed on Aug. 28, 2015, which is incorporated by reference herein in its entirety.

BACKGROUND OF THE INVENTION

1. Field of the Invention

The present invention relates to a self-weight pressure control valve located on a liquid supply path usable to supply a liquid from a liquid supply to a liquid injector, a liquid supply system including the same, and an inkjet recording device.

2. Description of the Related Art

An inkjet recording device for industrial use or the like adopts a structure in which a large capacity ink cartridge is located away from a carriage having an ink injection head mounted thereon, namely, an off-carriage system. Generally, in a recording device of the off-carriage system, an ink supply path usable to supply ink from the ink cartridge to the ink injection head is long. As a result, the ink pressure fluctuation is large in the ink supply path, and thus there may be a case where the ink is not injected stably from the ink injection head.

In such a situation, it has been conventionally desired to suppress the ink pressure fluctuation low. For example, WO2003/041964 discloses a structure in which an ink injection head and a valve unit are mounted on a carriage. The valve unit is a self-sealing valve, and has a function of adjusting the pressure of ink to be supplied to the ink injection head (self-sealing function). With the above-described structure, the ink is transmitted to the ink injection head at a predetermined pressure, and thus the ink is injected stably from the ink injection head.

The valve unit described in WO2003/041964 is put into a self-sealing state by a function of an urging member that urges the valve in such a direction as to close the valve. The urging member is, for example, a coiled seal spring. The seal spring is located at such a position as to be in contact with the ink. However, the seal spring is very small and coiled, and therefore, does not have a sufficient area size or thickness to be, for example, plated in order to improve the ink corrosion resistance. For this reason, the seal spring may be corroded and deteriorated after being used for a long time in the case where, for example, the ink contains a certain component. When the seal spring is corroded and deteriorated, the elastic force of the spring is decreased, and thus the urging force acting in such a direction as to close the valve is weakened. As a result, the self-sealing state is not stably maintained, which may cause a state where, for example, the injection of the ink during printing (during ink injection) is made unstable. In addition, while the printing is not performed, the ink may leak from the ink injection head.

SUMMARY OF THE INVENTION

Preferred embodiments of the present invention provide pressure control valves stably exhibiting a self-sealing function to properly reduce or prevent pressure fluctuations of a liquid during liquid injection. Preferred embodiments of the present invention also provide liquid supply systems including the pressure control valves, and provide inkjet recording devices.

A self-weight pressure control valve according to a preferred embodiment of the present invention is located on a liquid supply path usable to supply a liquid from a liquid supply to a liquid injector. The self-weight pressure control valve includes a hollow case main body including an opening; a partitioning wall that is located in the case main body and divides an inner space of the case main body into a first pressure chamber and a second pressure chamber in communication with the opening; an inlet that is provided in the case main body and is in communication with the first pressure chamber; an outlet that is provided in the case main body and is in communication with the second pressure chamber; a communication opening that is provided in the partitioning wall and communicates the first pressure chamber and the second pressure chamber to each other; a valve rod including a rod portion that has an outer diameter smaller than an inner diameter of the communication opening and is inserted through the communication opening so as to pass the partitioning wall, and a valve portion that has an outer diameter larger than the inner diameter of the communication opening and is located in the first pressure chamber; and a pressure sensitive film that is attached to the case main body so as to cover the opening of the case main body, is coupled with a tip of the rod portion of the valve rod, and is flexibly deformable toward the rod portion. The first pressure chamber is located above the second pressure chamber. The self-weight pressure control valve is structured to operate such that in a state where the pressure sensitive film is not flexibly deformed toward the rod portion, the communication opening is maintained in a closed state by the valve portion by use of a self-weight of the valve rod.

In the description of preferred embodiments of the present invention, "self-weight" refers to a load or gravitational force imposed by a body due to its mass.

In the above-described self-weight pressure control valve, the communication opening is opened or closed in association with the flexible deformation of the pressure sensitive film (displacement of the pressure sensitive film in the film thickness direction). Therefore, the self-weight pressure control valve is simply controllable with no need to be electrically controlled. With the above-described structure, while the pressure sensitive film is not flexibly deformed, the communication opening is maintained in the closed state (self-sealing state) by the self-weight of the valve rod. Therefore, an urging member such as a seal spring or the like, which is conventionally indispensable, is not necessary. This prevents the above-described problem caused by the corrosion and deterioration of the urging member. Namely, with the above-described structure, the self-sealing function is maintained for a long time appropriately, and thus the printing is performed with a high quality and highly reliably.

In a preferred embodiment of the present invention, the rod portion of the valve rod includes an end surface. The self-weight pressure control valve further includes a pressure receiving plate that is provided between the pressure sensitive film and the end surface of the rod portion and has a size larger than a size of the end surface of the rod portion.

According to the above-described preferred embodiment of the present invention, the flexible deformation of the pressure sensitive film is transmitted to the valve rod stably and efficiently. Therefore, the valve rod is movable more quickly and properly.

In another preferred embodiment of the present invention, the self-weight pressure control valve further includes a cushioning member located between the pressure receiving plate and the rod portion of the valve rod.

According to the above-described preferred embodiment, the valve rod is movable in an up-down direction smoothly. Therefore, the fluctuation in the pressure of the liquid (pulsation) caused by the opening and closing of the communication opening is significantly reduced or prevented.

In still another preferred embodiment of the present invention, the cushioning member is attached to a surface of the pressure receiving plate on the side of the valve rod.

According to the above-described preferred embodiment, the cushioning member and the pressure receiving plate are integrated together to put these elements into contact with each other stably and reliably. As a result, the displacement of the pressure sensitive film is transmitted to the valve rod more properly. Therefore, with the above-described structure, the valve rod is movable more stably and reliably.

In still another preferred embodiment of the present invention, the valve rod is preferably made of brass, for example.

According to the above-described preferred embodiment, corrosion caused by the liquid is reliably prevented. In addition, the self-weight of the valve rod is increased.

In still another preferred embodiment of the present invention, the valve portion of the valve rod preferably has a volume that occupies about 30% of a total capacity of the first pressure chamber, for example.

According to the above-described preferred embodiment, the self-weight of the valve rod is increased. When the pressure sensitive film is not flexibly deformed, the buoyancy of the valve rod is significantly reduced to maintain the self-sealing state in a preferred manner.

In still another preferred embodiment of the present invention, the first pressure chamber is provided with a filter.

According to the above-described preferred embodiment, in the case where the liquid is contaminated with foreign substances or a solid content in the liquid is coagulated, the foreign substances or the coagulated solid content are removed in a preferred manner. This realizes a higher printing quality.

In still another preferred embodiment of the present invention, an inner surface of the first pressure chamber of the case main body includes a linear protrusion provided thereon, the linear protrusion extending in a direction parallel or substantially parallel to an axial direction of the rod portion of the valve rod.

According to the above-described preferred embodiment, the valve rod is movable in the up-down direction smoothly. In addition, when the communication opening is opened, the liquid in the first pressure chamber flows in a gap between a portion of the inner surface of the first pressure chamber on which no linear protrusion is provided and the valve rod to reach the communication opening smoothly. Therefore, the liquid is movable smoothly from the first pressure chamber to the second pressure chamber.

In still another preferred embodiment of the present invention, the pressure receiving plate is provided with a through-hole extending in a direction from a surface thereof on the side of the pressure sensitive film to a surface thereof on the side of the valve rod.

According to the above-described preferred embodiment, the pressure receiving plate has a large pressure receiving surface area and is lightweight. As a result, the pressure sensitive film is flexibly deformed more quickly along with the fluctuation in an inner pressure of the second pressure chamber. Therefore, the valve rod is movable more efficiently and stably.

In another preferred embodiment of the present invention, a liquid supply system is provided. The liquid supply system includes a liquid supply that stores a liquid; a liquid injector that injects the liquid; a liquid supply path including an end in communication with the liquid supply and another end in communication with the liquid injector; and the self-weight pressure control valve located on the liquid supply path.

In still another preferred embodiment of the present invention, the liquid supply system further includes a support that supports the self-weight pressure control valve such that the axial direction of the rod portion of the valve rod of the self-weight pressure control valve is vertical.

According to the above-described preferred embodiment, the valve rod is more reliably operable in a stable manner.

In still another preferred embodiment of the present invention, the liquid injector includes a nozzle opened to the air. A surface of the pressure sensitive film of the self-weight pressure control valve opposite to the rod portion is exposed to the air.

The inner pressure of the second pressure chamber of the self-weight pressure control valve is made equal or substantially equal to the inner pressure in the nozzle. According to the above-described preferred embodiment, a change in the atmospheric pressure is dealt with appropriately with no complicated control. This properly prevents the ink from leaking from the nozzle. During the liquid injection, the ink is injected smoothly from the nozzle.

In still another preferred embodiment of the present invention, an inkjet recording device including the above-described liquid supply system is provided.

A self-weight pressure control valve according to a preferred embodiment of the present invention stably exhibits a self-sealing function to properly reduced or prevent the pressure fluctuation of a liquid during ink injection. This allows the liquid to be stably injected from the injection head.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, self-weight pressure control valves, liquid supply systems, and inkjet recording devices according to preferred embodiments of the present invention will be described with reference to the drawings. The preferred embodiments of the present invention described herein do not limit the present invention. Elements or features having the same function will be assigned the same reference signs, and repetitive descriptions will be omitted or simplified. In the following description, the term "up", "upper", "down", "lower" and "height" are based on the direction of gravity in the state where a self-weight pressure control valve is properly located at a predetermined position with a predetermined posture.

Figure 1:
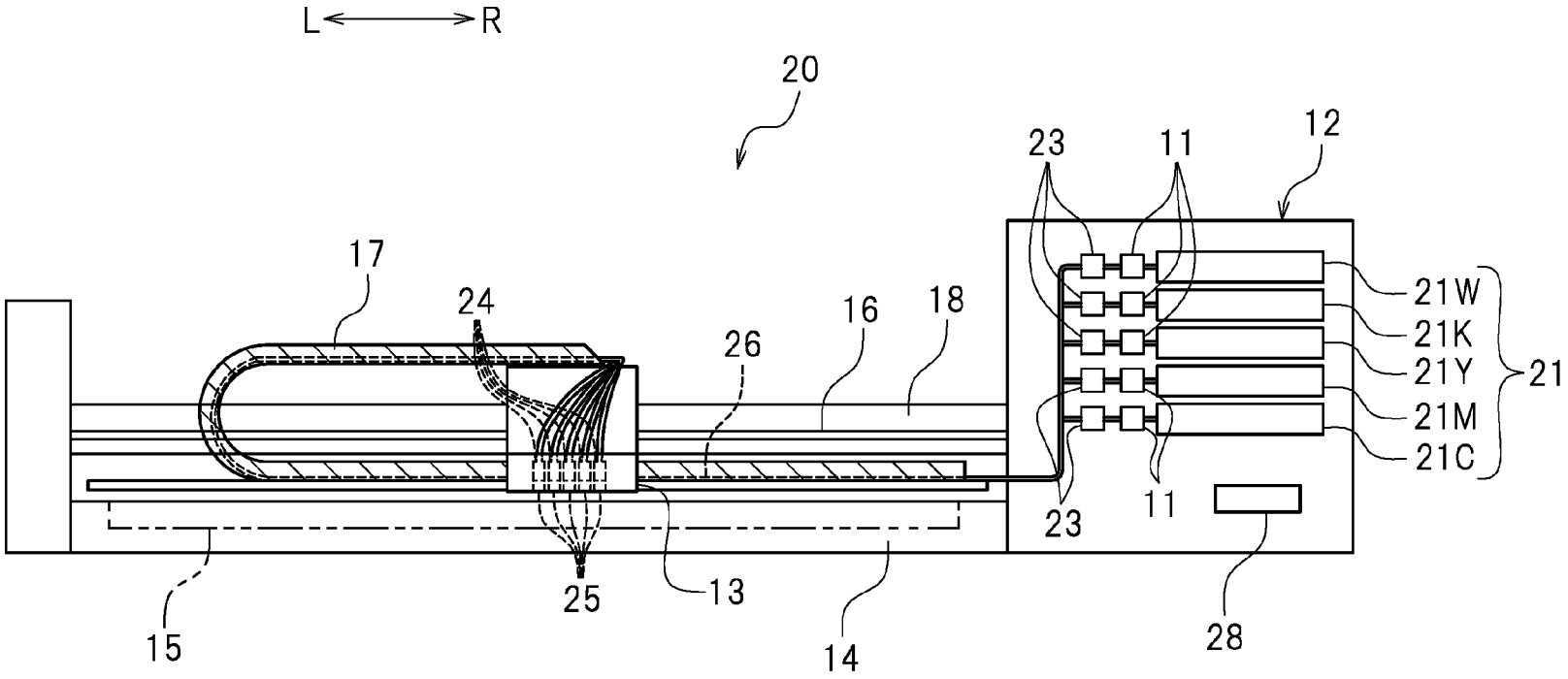
FIG. 1 is a front view of an inkjet printer according to a preferred embodiment of the present invention.
Figure 2:
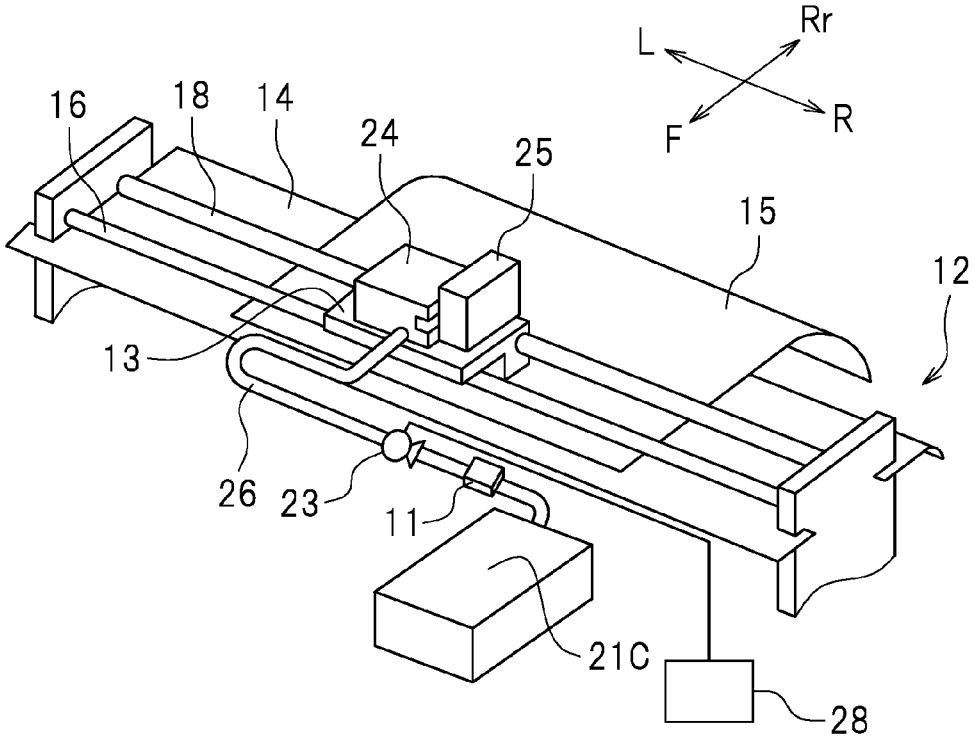
FIG. 2 is a partial perspective view of the inkjet printer shown in FIG. 1.

FIG. 1 is a front view of an inkjet printer (hereinafter, referred to as a "printer") 20 according to a preferred embodiment of the present invention. The printer 20 is an example of an inkjet recording device. In FIG. 1 and FIG. 2, reference signs L and R respectively refer to "left" and "right". In FIG. 1, the closer side to, and the farther side from, the viewer of FIG. 1 are respectively the front side and the rear side. It should be noted that these directions are merely provided for the sake of convenience, and do not limit the manner of installation of the printer 20 in any way.

The printer 20 performs printing on a recording paper sheet 15, which is a recording medium. The "recording medium" encompasses paper such as plain paper or the like, and also a recording medium formed of a resin material such as polyvinyl chloride (PVC), polyester or the like and a recording medium formed of any of various other materials such as aluminum, iron, wood or the like.

The printer 20 includes a printer main body 12, and a guide rail 18 secured to the printer main body 12. The guide rail 18 extends in a left-right direction. The guide rail 18 is in engagement with a carriage 13. Although not shown, the guide rail 18 is provided with a roller at each of a left end and a right end thereof. One roller among these rollers is coupled with a carriage motor (not shown). The one roller is drivable to rotate by the carriage motor. Both of the rollers are each wound around by an endless belt 16. The carriage 13 is secured to the belt 16. When the rollers rotate and the belt 16 runs, the carriage 13 moves in the left-right direction. In this manner, the carriage 13 moves in the left-right direction along the guide rail 18.

The printer main body 12 includes a platen 14 supporting the recording paper sheet 15. The platen 14 is provided with a pair of rollers, namely, an upper grid roller and a lower pinch roller (not shown). The grid roller is coupled with a field motor (not shown). The grid roller is drivable to rotate by the field motor. When the grid roller rotates in the state where the recording paper sheet 15 is held between the grid roller and the pinch roller, the recording paper sheet 15 is transported in a front-rear direction.

The printer main body 12 is provided with a plurality of ink cartridges 21. The ink cartridges 21 are tanks (liquid supplies) storing ink. Specifically, the plurality of ink cartridges 21C, 21M, 21Y, 21K and 21W are detachably attached to the printer main body 12. The ink cartridge 21C stores cyan ink. The ink cartridge 21M stores magenta ink. The ink cartridge 21Y stores yellow ink. The ink cartridge 21K stores black ink. The ink cartridge 21W stores white ink. The ink cartridges 21C, 21M, 21Y, 21K and 21W each have an ink removal outlet (not shown) attached thereto.

The printer 20 includes an ink supply system for ink of each of colors. The ink supply system includes a self-weight pressure control valve 11, an ink injection head (liquid injector) 25, and an ink supply path (liquid supply path) 26. In this preferred embodiment, the ink supply system further includes a supply pump 23 and a damper 24. The printer 20 further includes a controller 28.

The ink ejection head 25 and the damper 24 are mounted on the carriage 13 and reciprocally move in the left-right direction. By contrast, the ink cartridge 21 is not mounted on the carriage 13 and does not reciprocally move in the left-right direction. A majority of the ink supply path 26 (at least half of the total length thereof) extends in the left-right direction so as not to be broken even when the carriage 13 moves in the left-right direction. In this preferably embodiment, five types of ink preferably are used, for example, and therefore, a total of five ink supply paths 26 are provided. The ink supply paths 26 are covered with a cable protection and guide device 17. The cable protection and guide device 17 is, for example, a cableveyor (registered trademark).

Figure 3:
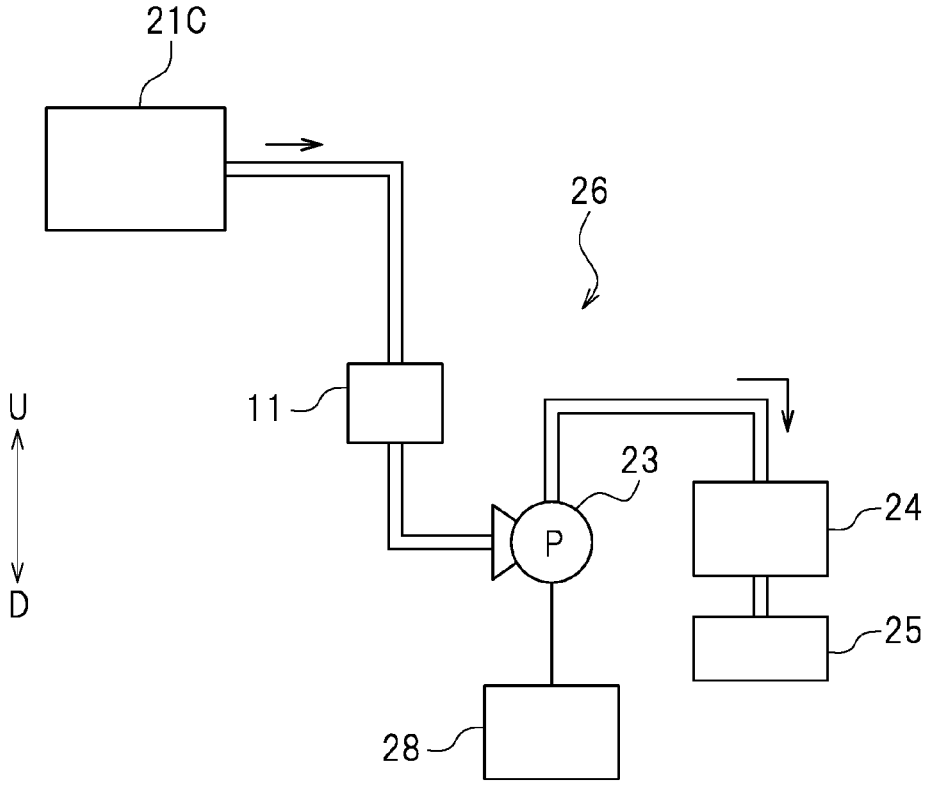
FIG. 3 is a block diagram showing a structure, of the inkjet printer shown in FIG. 1, in which ink is supplied from an ink cartridge to an ink injection head.

In the following description, the ink supply system provided for the ink cartridge 21C storing cyan ink will be explained as an example. FIG. 2 is a partial perspective view of the printer 20. FIG. 3 is a schematic view showing a structure in which the ink is supplied from the ink cartridge 21C to the ink injection head 25. In FIG. 3, the arrows represent the direction in which the ink flows during the printing. In FIG. 2, reference signs F and Rr respectively refer to "front" and "rear". In FIG. 3 and the like, reference signs U and D respectively refer to "up" and "down" regarding the direction of gravity.

The ink injection head 25 injects the ink. On a lower surface of the ink injection head 25, a plurality of nozzles (not shown) through which the ink is to be injected are provided. Inside the ink injection head 25, an actuator (not shown) including a piezoelectric element or the like is provided. The actuator is driven to inject the ink from the nozzles.

The ink cartridge 21C and the ink injection head 25 are in communication with each other via the ink supply path 26. The ink supply path 26 defines a flow path that guides the ink from the ink cartridge 21C to the ink injection head 25. The ink supply path 26 is soft and flexible. There is no specific limitation on the structure of the ink supply path 26. The ink supply path 26 preferably is, for example, a deformable tube formed of a resin.

The damper 24 is provided on the ink supply path 26. The damper 24 is in communication with the ink injection head 25, and provides the ink to the ink injection head 25. The damper 24 alleviates the pressure fluctuation of the ink to stabilize the ink injection operation of the ink injection head 25.

The supply pump 23 is provided on the ink supply path 26. The supply pump 23 is a liquid transmission device that supplies the ink from the ink cartridge 21C toward the ink injection head 25. The supply pump 23 is a tube pump of, for example, a trochoid pump system.

The controller 28 is configured or programmed to control the supply pump 23 to be actuated or stopped. Thus, the controller 28 is configured or programmed to control the supply of the ink from the ink cartridge 21C to the ink injection head 25. The controller 28 is preferably a computer. The controller 28 may include a central processing unit (CPU) and a ROM or a RAM storing a program or the like to be executed by the CPU.

Figure 4:
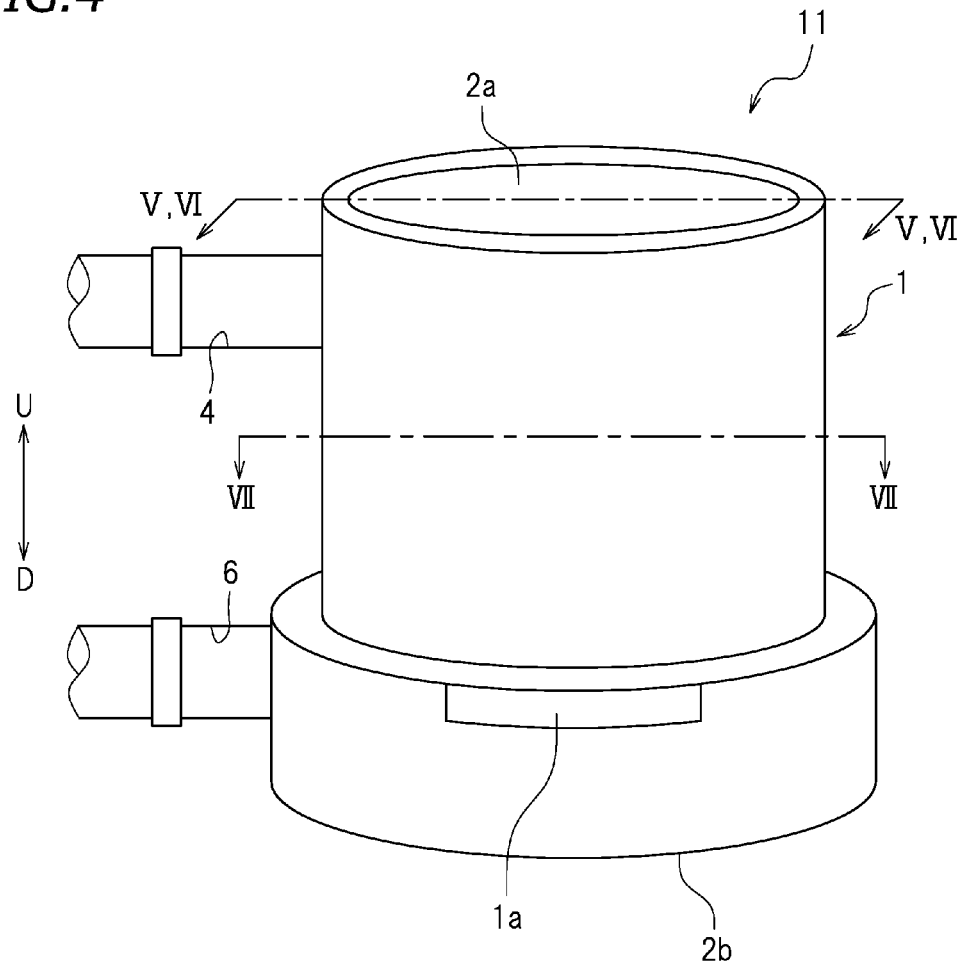
FIG. 4 is a perspective view of a self-weight pressure control valve according to a preferred embodiment of the present invention.
Figure 5:
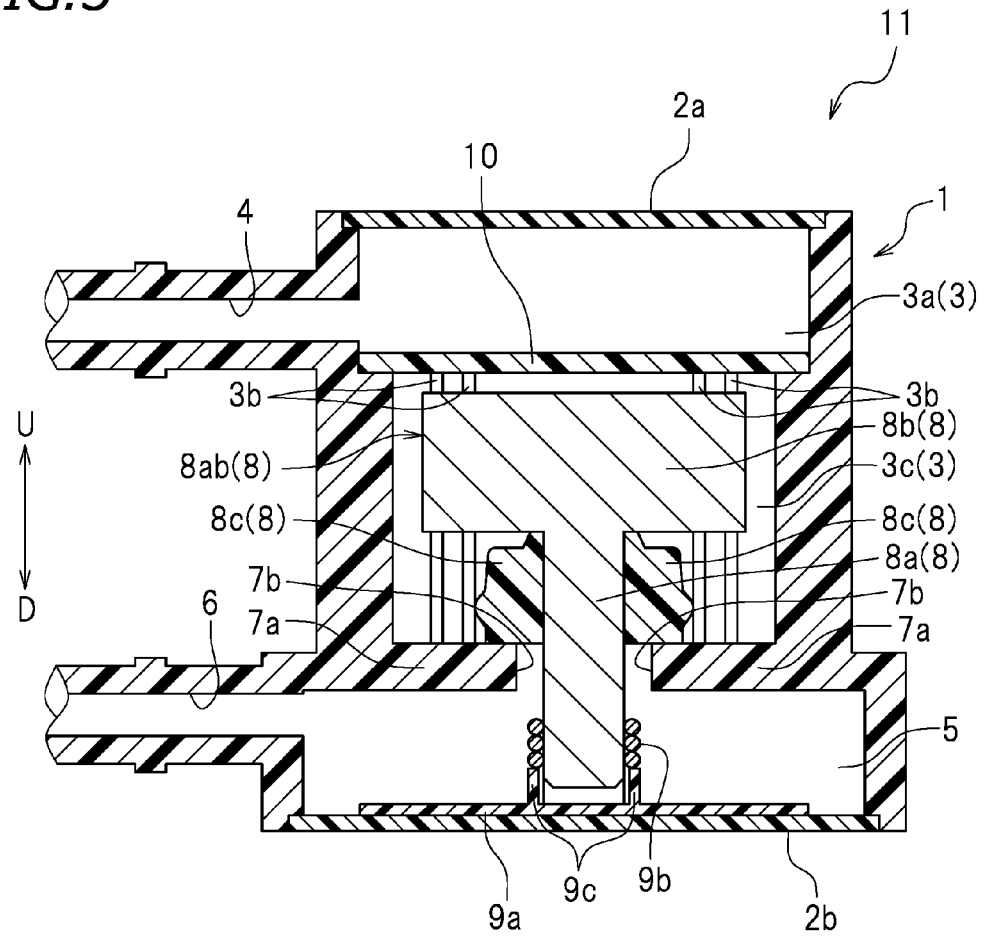
FIG. 5 is a vertical cross-sectional view of the self-weight pressure control valve shown in FIG. 4 taken along line V-V in FIG. 4.
Figure 6:
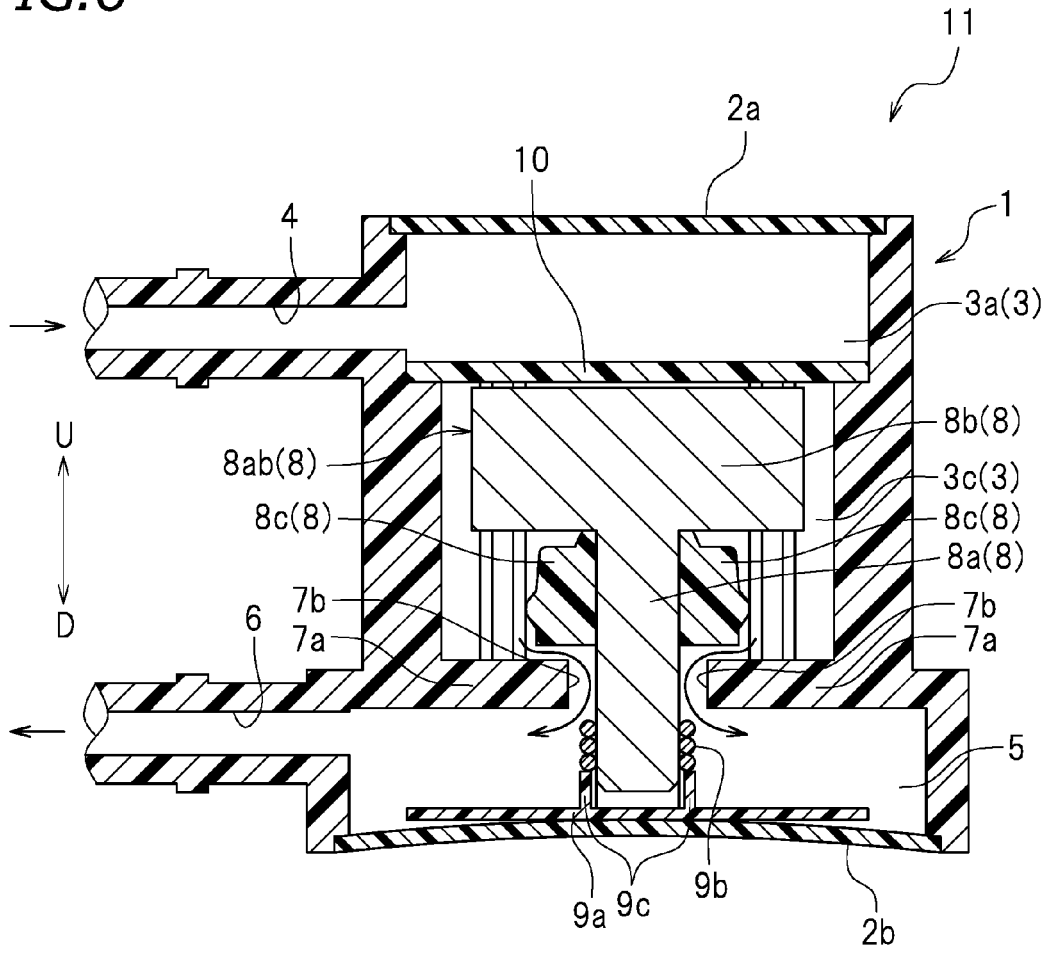
FIG. 6 shows a state where a communication opening shown in FIG. 5 is open.

The self-weight pressure control valve 11 acts to alleviate the pressure fluctuation of the ink during the printing (e.g., during ink injection). The self-weight pressure control valve 11 also acts to maintain the ink supply path 26 in a closed state while the printing is not performed (e.g., while the ink is not injected). FIG. 4 is a perspective view of the self-weight pressure control valve 11 according to a preferred embodiment of the present invention. FIG. 5 is a vertical cross-sectional view of the self-weight pressure control valve 11 shown in FIG. 4 taken along line V-V in FIG. 4. FIG. 6 shows a state where a communication opening 7*b* shown in FIG. 5 is open.

The self-weight pressure control valve 11 in this preferred embodiment includes a hollow case main body 1 provided with an opening, and a pressure sensitive film 2*b* attached to the case main body 1 so as to cover the opening of the case main body 1. The case main body 1 is preferably formed of a resin. In this example, the case main body 1 is cylindrical or substantially cylindrical, for example. The pressure sensitive film 2*b* is flexibly deformable in a thickness direction in response to a pressure load. In more detail, the pressure sensitive film 2*b* is flexibly deformed upward when a pressure below the pressure sensitive film 2*b* becomes larger than a pressure above the pressure sensitive film 2*b*. Namely, the self-weight pressure control valve 11 in this preferred embodiment is a diaphragm system. Inside the case main body 1, a partition wall 7*a* demarcating an inner space of the case main body 1 into two spatial areas 3 and 5 is provided. In other words, the case main body 1 is divided into the two spatial areas, i.e., a first pressure chamber 3 and a second pressure chamber 5, in the up-down direction.

In this preferred embodiment, the case main body 1 is open in an upper surface thereof, and a thin film member 2*a* is attached so as to cover the opening. The thin film member 2*a* is attached to an edge of the upper surface of the case main body 1. The thin film member 2*a* is, for example, a resin film. The thin film member 2*a* may or may not be flexible. In this example, the thin film member 2*a* is preferably disc-shaped or substantially disc-shaped. The thin film member 2*a* is perpendicular or substantially perpendicular with respect to the direction of gravity. A spatial area enclosed by the case main body 1, the thin film member 2*a* and the partition wall 7*a* is the first pressure chamber 3. An ink inlet 4, through which the ink flows into the first pressure chamber 3, is provided in a left wall of the first pressure chamber 3. The ink inlet 4 is in communication with the ink cartridge 21C via the ink supply path 26.

In the first pressure chamber 3, a filter 10 is provided. In the case where the ink is contaminated with foreign substances or a solid content in the ink is coagulated, the filter 10 provided in the first pressure chamber 3 removes the foreign substances or the coagulated solid content in a preferred manner. The filter 10 preferably is defined by nonwoven cloth having resin or metal filaments entangled therein or preferably is defined by resin or metal filaments knitted into a mesh, for example. In this preferred embodiment, the filter 10 is preferably disc-shaped or substantially disc-shaped and has an equivalent size or substantially equivalent size to that of the thin film member 2*a*. The filter 10 is located such that surfaces thereof in a thickness direction are parallel or substantially parallel to the thin film member 2*a*. In other words, the filter 10 is located perpendicular or substantially perpendicular with respect to the direction of gravity. This allows a cross-section of the filter 10 perpendicular of substantially perpendicular to the direction of flow of the ink to have a large area size. Even in the case where the foreign substances or the like are caught by the filter 10, the filter 10 is prevented from blocking the flow of the ink. The first pressure chamber 3 is divided in the up-down direction into two spatial areas, i.e. an upper portion 3*a* and a lower portion 3*c*, by the filter 10.

The case main body 1 is open in a lower surface thereof, and a pressure sensitive film 2*b* is attached so as to cover the opening. The pressure sensitive film 2*b* is formed of a material that is flexible and has a low gas permeability or water vapor permeability. A surface of the pressure sensitive film 2*b* that is to be in contact with the ink may be preferably formed of a material having a high ink corrosion resistance. The pressure sensitive film 2*b* is, for example, a resin film. In this example, the pressure sensitive film 2*b* is preferably disc-shaped or substantially disc-shaped. The pressure sensitive film 2*b* is located perpendicular or substantially perpendicular with respect to the direction of gravity. A spatial area enclosed by the case main body 1, the pressure sensitive film 2*b* and the partition wall 7*a* is the second pressure chamber 5. The pressure sensitive film 2*b* is attached to an edge of the lower surface of the case main body 1 at such a tensile strength as to be flexibly deformed internally into the second pressure chamber 5 (to the side of a rod portion 8*a*). An ink outlet 6, through which the ink flows out of the second pressure chamber 5, is provided in a left wall of the second pressure chamber 5. The ink outlet 6 is in communication with the ink cartridge 21C via the ink supply path 26.

A portion of the partition wall 7*a* is provided with a communication opening 7*b* communicating the first pressure chamber 3 and the second pressure chamber 5 to each other. In the communication opening 7*b*, a valve rod (valve member) 8 is located. The valve rod 8 is movable in the up-down direction regarding the direction of gravity in association with displacement (degree of flexible deformation) of the pressure sensitive film 2*b*. This opens or closes the communication opening 7*b*. The valve rod 8 is coupled with the pressure sensitive film 2*b*. The valve rod 8 includes a valve rod main body 8*ab* and a sealing member 8*c*. The valve rod main body 8*ab* preferably has a T-shaped vertical cross-section. Namely, the valve rod main body 8*ab* includes the rod portion 8*a*, which is preferably I-shaped (long shaft-shaped), and a valve portion 8*b*, which is preferably horizontal rod-shaped.

The rod portion 8*a* has an outer diameter smaller than an inner diameter of the communication opening 7*b*. The rod portion 8*a* is inserted through the communication opening 7*b* so as to pass the partition wall 7*a*. The rod portion 8*a* extends from the first pressure chamber 3 to the second pressure chamber 5 (downward in FIG. 2) through the communication opening 7*b*. A tip of the rod portion 8*a* is coupled with the pressure sensitive film 2*b*. The rod portion 8*a* is located parallel or substantially parallel to the direction of gravity. As a result, the rod portion 8*a* and the pressure sensitive film 2*b* are perpendicular or substantially perpendicular to each other, and thus the displacement of the pressure sensitive film 2*b* is efficiently transmitted to the valve rod 8. In addition, the valve rod 8 is guaranteed to operate stably. The valve portion 8*b* has an outer diameter larger than the inner diameter of the communication opening 7*b*. The valve portion 8*b* is located in the first pressure chamber 3. The valve portion 8*b* defines and functions as a weight.

The sealing member 8*c* is located between the valve rod main body 8*ab* and the partition wall 7*a*. In this preferred embodiment, the sealing member 8*c* preferably has an annular shape (similar to an O-ring) on a circumferential surface of the rod portion 8*a*. The sealing member 8*c* is in close contact with the valve rod main body 8*ab*, and is also closely contactable with the partition wall 7*a* to close the communication opening 7*b*. The sealing member 8*c* may be preferably formed of an elastic material. The sealing member 8*c* may be preferably formed of a material having a high ink corrosion resistance. In this example, the sealing member 8*c* is preferably formed of rubber.

The valve rod 8 is preferably formed of a material having a high ink corrosion resistance. The valve rod main body 8*ab* is preferably formed of a metal material, for example, brass, copper, silver, platinum, gold, stainless steel or the like. Among these materials, the valve rod 8 may be preferably formed of a material having a specific gravity of about 8 g/cm$^3$ or greater, preferably about 8.4 g/cm$^3$ or greater, for example. This increases the weight (self-weight) of the valve rod 8. Therefore, when the pressure sensitive film 8*b* is not flexibly deformed, the buoyancy of the valve rod 8 is significantly reduced and the valve rod 8 is pressed in the direction of gravity by the self-weight thereof. This maintains the communication opening 7*b* in the closed state in a preferred manner. In this preferred embodiment, the valve rod 8*ab* is preferably made of brass from the point of view of increasing the self-weight of the valve rod and reducing the cost. Brass is an alloy of copper and zinc. The specific gravity of brass may vary in accordance with the composition ratio, and is generally about 8.4 g/cm$^3$ to about 8.6 g/cm$^3$.

In this preferred embodiment, the valve rod 8 (especially, the valve portion 8*b*) is preferably larger than in the conventional art in order to increase the self-weight of the valve rod 8. The valve rod 8 occupies a majority of the capacity of the lower portion 3*c* of the first pressure chamber 3. This reduces the buoyancy of the valve rod 8, and thus better maintains the closed state of the communication opening 7*b* by the self-weight of the valve rod 8. From the point of view of reducing the buoyancy of the valve rod 8 to guarantee that the self-weight of the valve rod 8 acts in a preferred manner, the volume of the valve portion 8*b* may be preferably at least about 30%, for example, at least about 40%, of the total capacity of the first pressure chamber 3. From the point of view of allowing the ink to flow smoothly in the self-weight pressure control valve 11, the volume of the valve portion 8*b* may be preferably at most about 80%, preferably at most about 70%, preferably at most about 60%, of the total capacity of the first pressure chamber 3, for example. In this preferred embodiment, where the "total capacity of the first pressure chamber 3", namely, the total capacity of the two spaces 3*a* and 3*c* divided by the filter 10, is about 100%, the volume of the valve portion 8*b* occupies about 41% and the total volume of the valve portion 8*b* and the sealing member 8*c* occupies about 48%, for example.

Figure 7:
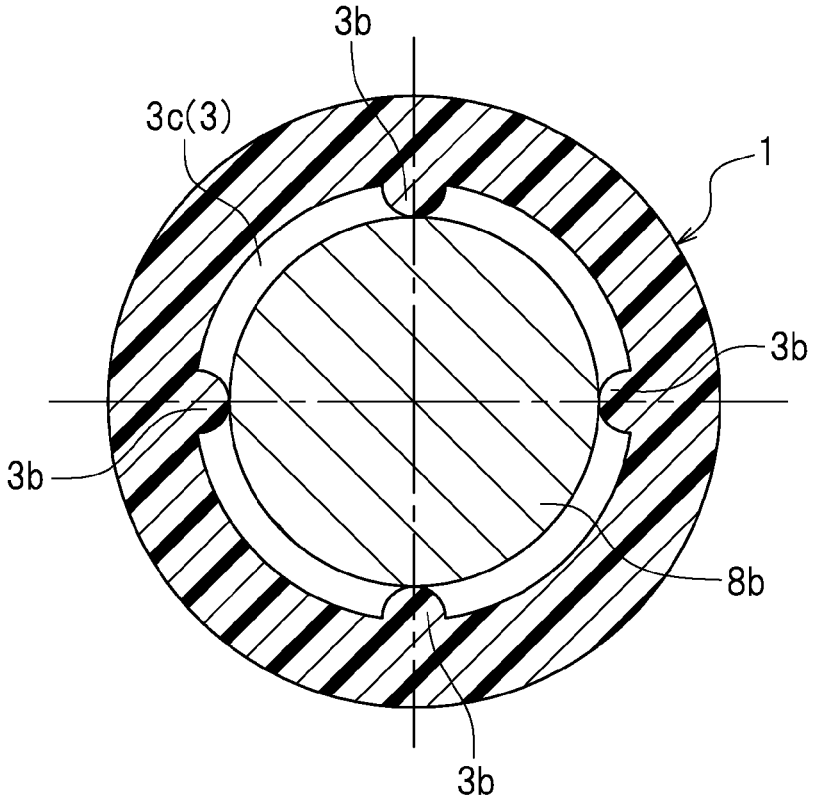
FIG. 7 is a horizontal cross-sectional view of the self-weight pressure control valve shown in FIG. 4 taken along line VII-VII in FIG. 4.

FIG. 7 is a horizontal cross-sectional view of the self-weight pressure control valve 11 shown in FIG. 4 taken along line VII-VII in FIG. 4. FIG. 7 shows a cross-section of the lower portion 3*c* of the first pressure chamber 3 of the case main body 1. In this preferred embodiment, the case main body 1 preferably has a circular or substantially circular cross-section. The lower portion 3*c* of the first pressure chamber 3 preferably has a circular or substantially circular cross-section having a diameter slightly smaller than an inner diameter of the case main body 1. At a center of the cross-section of the lower portion 3*c* of the first pressure chamber 3, the valve portion 8*b* of the valve rod main body 8*ab* is located. The valve portion 8*b* preferably has a circular or substantially circular cross-section having a diameter slightly smaller than the diameter of the lower portion 3*c* of the first pressure chamber 3 from the point of view of allowing the ink to flow smoothly.

In this preferred embodiment, the valve rod 8 occupies a majority of the capacity of the first pressure chamber 3. Therefore, in the first pressure chamber 3, the flow of the ink from the ink inlet 4 toward the communication opening 7*b* tends to be slower than in the case where the valve rod 8 is smaller. In order to avoid this, in this preferred embodiment, four linear protrusions 3*b* preferably are provided on an inner surface of the first pressure chamber 3. The linear protrusions 3*b* are provided at an equal or substantially equal interval and extend straight or substantially straight in a direction in which the valve rod 8 is movable, namely, in a direction parallel or substantially parallel to an axial direction of the rod portion 8*a*. The linear protrusions 3*b* are in contact with the valve portion 8*b*. With such a structure, even in a preferred embodiment in which the ink flow path is narrow in the first pressure chamber 3 as shown in, for example, FIG. 7, the ink flows in a gap between a portion of the inner surface of the first pressure chamber 3 on which no linear protrusion 3*b* is provided and the valve rod 8 to reach the communication opening 7*b* smoothly. Therefore, when the communication opening 7*b* is opened, the ink is movable smoothly from the first pressure chamber 3 to the second pressure chamber 5. The linear protrusions 3*b* also have a function of stabilizing the position of the valve rod 8. Namely, the linear protrusions 3*b*, for example, prevent the valve rod 8 from being eccentric leftward, rightward, forward or rearward in FIG. 7. This allows the valve rod 8 to move stably in the up-down direction and thus stabilizes the flow of the ink.

As described in WO2003/041964 and the like, a general pressure control valve requires an urging member (e.g., seal spring) that urges the valve rod to a closing position. By contrast, the structure disclosed in this specification allows the communication opening 7*b* to be maintained in the closed state (self-sealing state) in a preferred manner by adjusting, for example, the material or the size of the valve rod 8 with no use of the urging member, which is conventionally indispensable.

The rod portion 8*a* of the valve rod main body 8*ab* includes an end surface on the side of the pressure sensitive film 2*b*. A pressure receiving plate 9*a* is located between the pressure sensitive film 2*b* and the end surface of the rod portion 8*a*. The pressure receiving plate 9*a* is placed on the surface of the pressure sensitive film 2*b*. The pressure receiving plate 9*a* and the rod portion 8*a* of the valve rod main body 8*ab* are perpendicular or substantially perpendicular to each other. In other words, the pressure receiving plate 9*a* is located perpendicular or substantially perpendicular to the direction of gravity. The pressure receiving plate 9*a* allows the displacement of the pressure sensitive film 2*b*, caused by the flexible deformation thereof, to be transmitted to the valve rod 8 stably. In this preferred embodiment, the pressure receiving plate 9*a* has a pressure receiving area size (i.e., the size of the area on which the displacement of the pressure sensitive film 2*b* acts) that is larger than the area size of the end surface of the rod portion 8*a* on the side of the pressure sensitive film 2*b*. The pressure receiving area size of the pressure receiving plate 9*a* is smaller than the area size of the surface of the pressure sensitive film 2*b* so that the flexible deformation of the pressure sensitive film 2*b* is not inhibited. With such a structure, the flexible deformation of the pressure sensitive film 2*b* is transmitted efficiently and stably to the valve rod 8.

The pressure receiving plate 9*a* is preferably made of a material harder than that of the pressure sensitive film 2*b*. The material of the pressure receiving plate 9*a* is relatively lightweight so that the displacement of the pressure sensitive film 2*b* is not inhibited. In addition, the material of the pressure receiving plate 9*a* may preferably have a high ink corrosion resistance. The pressure receiving plate 9*a* is preferably made of, for example, a resin such as polyethylene, polypropylene or the like. There is no specific limitation on the shape of the pressure receiving plate 9*a*. In this example, the pressure receiving plate 9*a* is preferably disc-shaped or substantially disc-shaped and is slightly smaller than the pressure sensitive film 2*b*.

Figure 8A:
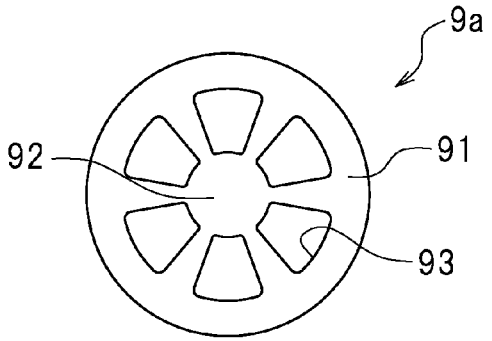
FIG. 8A shows a modification of a pressure receiving plate.
Figure 8B:
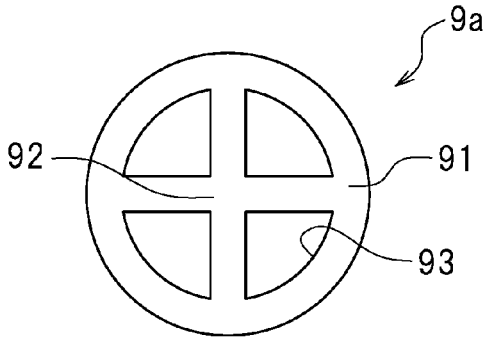
FIG. 8B shows a modification of the pressure receiving plate.
Figure 8C:
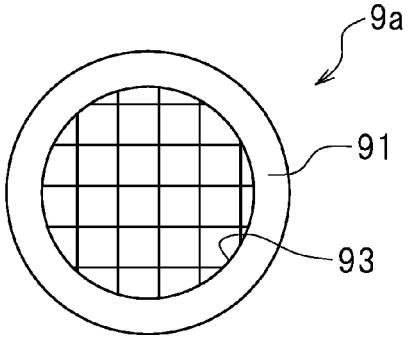
FIG. 8C shows a modification of the pressure receiving plate.
Figure 8D:
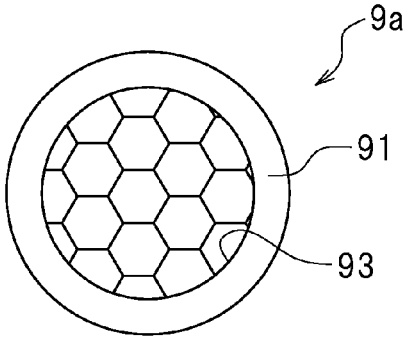
FIG. 8D shows a modification of the pressure receiving plate.

FIG. 8A to FIG. 8D show modifications of the pressure receiving plate 9*a*. In FIG. 8A and FIG. 8B, the pressure receiving plate 9*a* preferably has a shape of lotus root, and includes an annular outer peripheral portion 91 having a constant or substantially constant width and an intersection portion 92 located inner to the outer peripheral portion 91 and extending between portions of an inner surface of the outer peripheral portion 91. Portions of the intersection portion 92 extending radially have a constant or substantially constant width. In the pressure receiving plate 9*a* shown in FIG. 8C, a portion inner to the annular outer peripheral portion 91 is meshed. In the pressure receiving plate 9*a* shown in FIG. 8D, a portion inner to the annular outer peripheral portion 91 preferably is honeycomb-shaped. The pressure receiving plates 9*a* shown in FIG. 8A to FIG. 8D as examples all have a through-hole 93 extending in a thickness direction from a surface thereof on the side of the pressure sensitive film 2*b* to a surface thereof on the side of the valve rod 8. The pressure receiving plate 9*a* having such a through-hole has a large pressure receiving surface area and is lightweight. As a result, the pressure sensitive film 2*b* is flexibly deformed more quickly along with the fluctuation in an inner pressure of the second pressure chamber 5.

A coil spring 9*b* is provided between the pressure receiving plate 9*a* and the rod portion 8*a* of the valve rod 8. Specifically, a ring-shaped protrusion 9*c* is provided on the surface of the pressure receiving plate 9*a* on the side of the valve rod 8. The protrusion 9*c* secures an end of the coil spring 9*b* to the surface of the pressure receiving plate 9*a* on the side of the rod portion 8*a*. In more detail, the coil spring 9*b* is wound around an outer surface of the protrusion 9*c*. The pressure receiving plate 9*a* and the coil spring 9*b* are integrated together to put these elements into contact with each other stably. The coil spring 9*b* provided between the pressure receiving plate 9*a* and the valve rod 8 prevents the pressure sensitive film 2*b* from flexibly deformed externally from the second pressure chamber 5 (downward in FIG. 2). With such a structure, an inner pressure of the self-weight pressure control valve 11 is maintained to be negative pressure. Namely, the coil spring 9*b* acts as a negative pressure maintaining member that pulls the pressure sensitive film 2*b* upward. While the printing is not performed, the inner pressure of the second pressure chamber 5 is made equal or substantially equal to the pressure in the nozzles (not shown) of the ink injection head 25. The nozzles are opened to the air. Therefore, the inner pressure of the second pressure chamber 5 is a negative pressure, and thus ink leakage from the nozzles is prevented.

The coil spring 9*b* has a winding diameter that is slightly larger than a diameter of the end surface of the rod portion 8*a* on the side of the pressure sensitive film 2*b*. The coil spring 9*b* allows the end surface of the rod portion 8*a* on the side of the pressure sensitive film 2*b* to be inserted thereinto. Insertion of the end surface of the valve rod main body 8*ab* into the coil spring 9*b* allows the valve rod 8 and the pressure receiving plate 9*a* to be put into contact with each other stably. The insertion of the end surface also allows the valve rod 8 to move in the up-down direction smoothly. As a result, the fluctuation in the pressure of the ink (pulsation) is significantly reduced or prevented. Namely, the coil spring 9*b* also acts as a cushioning member.

While the printing is not performed, namely, while the ink is not injected from the ink injection head 25, the ink of an amount exceeding a predetermined amount is stored in the second pressure chamber 5. Therefore, the sealing member 8*c* of the valve rod 8 is pressed to the partition wall 7*a* by the self-weight thereof as shown in FIG. 5. This maintains the self-sealing state in which the communication opening 7*b* is closed. In other words, the communication opening 7*b* is not opened unless the amount of the ink in the second pressure chamber 5 is decreased to the predetermined amount to generate a negative pressure state in the second pressure chamber 5. With the structure disclosed in this specification, the self-weight of the valve rod 8 is utilized to realize the self-sealing state. Therefore, the self-sealing function is maintained for a long time appropriately with no need of an urging member such as a seal spring or the like.

By contrast, when the printer 20 starts printing, the supply pump 23 is driven by the controller 28. At the same time, the ink is injected toward the recording paper sheet 15 from the nozzles of the ink injection head 25. When the ink is injected, the ink stored in the damper 24 is supplied to the ink injection head 25. When an ink storage amount detector (not shown) detects that the amount of the ink stored in the damper 24 is too small, the controller 28 drives the supply pump 23. As a result, the ink in the second pressure chamber 5 of the self-weight pressure control valve 11 is absorbed toward the ink injection head 25 and is transmitted to the damper 24. Then, the amount of the ink stored in the second pressure chamber 5 is decreased to generate a negative pressure state in the second pressure chamber 5. As a result, as shown in FIG. 6, the pressure sensitive film 2*b* is pressed by the atmospheric pressure to be flexibly deformed internally into the second pressure chamber 5 (upward in FIG. 6). This motion of the pressure sensitive film 2*b* pushes up the valve rod 8 against the weight of the valve rod 8 itself (against the self-weight of the valve rod 8). Then, the sealing member 8*c* of the valve rod 8 is separated from the partition wall 7*a* to open the communication opening 7*b*. When the communication opening 7*b* is opened, the ink flows from the first pressure chamber 3 into the second pressure chamber 5. In FIG. 6, the direction of the flow of the ink is represented by the arrows.

As the ink flows from the first pressure chamber 3 into the second pressure chamber 5, the negative pressure state in the second pressure chamber 5 is cancelled. Along with this, the upward flexible deformation of the pressure sensitive film 2*b* is alleviated. This moves the valve rod 8 downward by the self-weight thereof. When, as a result, the sealing member 8*c* of the valve rod 8 and the partition wall 7*a* contact each other, the communication opening 7*b* is closed. The valve rod 8 moves up and down relatively smoothly by use of the self-weight thereof. Therefore, the amount of fluctuation in the pressure of the ink along with the opening and closing of the communication opening 7*b* is significantly reduced or prevented. With the above-described structure, the communication opening 7*b* is opened or closed in association with the flexible deformation of the pressure sensitive film 2*b*.

Therefore, the self-weight pressure control valve 11 is simply controllable with no need to be electrically controlled.

The first pressure chamber 3 of the self-weight pressure control valve 11 is in communication with the ink cartridge 21C. Therefore, when the amount of the ink is decreased in the first pressure chamber 3, the ink is supplemented from the ink cartridge 21C by the decreased amount. With the above-described structure, during the printing, the ink is supplied stably from the ink cartridge 21C to the ink injection head 25, and thus the printing is reliably performed with a high quality.

As described above, the self-weight pressure control valve 11 disclosed in this specification utilizes the self-weight of the valve rod 8 to close the communication opening 7*b*. Therefore, it is preferred that the self-weight pressure control valve 11 is secured so as not to be movable from the point of view of guaranteeing a stable operation of the valve rod 8. In other words, a support portion may be preferably provided that supports the self-weight pressure control valve 11 such that the axial direction of the rod portion 8*a* of the valve rod 8 is vertical. For example, the self-weight pressure control valve 11 may be preferably attached to a horizontal table by a securing tool.

A surface of the pressure sensitive film 2*b* opposite to the rod portion 8*a* (outer surface of the pressure sensitive film 2*b*) may be preferably in contact with the air. In this case, when the atmospheric pressure is changed, the pressure applied to the outer surface of the pressure sensitive film 2*b* is automatically changed in accordance therewith. Therefore, such a change in the atmospheric pressure is dealt with appropriately with no complicated control. This properly prevents the ink from leaking from the nozzles, and also allows the ink to be injected smoothly from the nozzles during the printing. Regarding this point, the above-described table may be preferably provided with a through-hole of a size equal to, or larger than, the size of the pressure sensitive film 2*b*. The through-hole may be formed in an area on which the pressure sensitive film 2*b* is to be placed. For example, the self-weight pressure control valve 11 may be preferably attached to an edge of the through-hole formed in the table by a securing member 1*a* (FIG. 4).

Preferred embodiments of the present invention are described above. The above-described preferred embodiments are merely examples, and the present invention may be carried out in any of various other embodiments.

For example, in each of the above-described preferred embodiments, the liquid stored in the liquid supplies preferably is ink. The liquid is not limited to ink. The liquid may be, for example, a washing liquid or the like usable for maintenance of the recording device.

In the above-described preferred embodiments, the inkjet recording device preferably is the inkjet printer 20. The inkjet recording device is not limited to an inkjet printer. The inkjet recording device may be any device capable of recording an image. The ink supply systems of the inkjet printer 20 described above each include the ink cartridge 21 (liquid supply), the ink injection head (liquid injector) 25, the ink supply path (liquid supply path) 26, the self-weight pressure control valve 11, the supply pump 23, the damper 24, and the controller 28. The ink supply systems of the inkjet printer 20 are not limited to including these elements. For example, the supply pump 23 and/or the damper 24 may be provided when necessary. Alternatively, the ink supply systems may each include a cap that covers the nozzles of the ink injection head 25 while the printing is not performed and a suction pump that absorbs the liquid in the cap, in addition to the above-described elements.

In the above-described preferred embodiments, the self-weight pressure control valve 11 is included in the inkjet recording device. The self-weight pressure control valve 11 is not limited to being included in an inkjet recording device. The self-weight pressure control valve 11 is usable in various devices including a liquid supply system, for example, in various production devices adopting an inkjet system, and measuring devices such as a micropipette and the like.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A pressure control valve located on a liquid supply path usable to supply a liquid from a liquid supply to a liquid injection head, the pressure control valve comprising:

a housing including an opening that connects a first pressure chamber and a second pressure chamber to each other, and a wall that divides an inner space of the housing into the first pressure chamber and the second pressure chamber in communication with the opening;

an inlet in the housing that communicates with the first pressure chamber;

an outlet in the housing that communicates with the second pressure chamber;

a valve rod that has an outer diameter smaller than an inner diameter of the opening, and a valve that has an outer diameter larger than the inner diameter of the opening and is located in the first pressure chamber; and a pressure sensitive film that is attached to the housing to cover the opening, is coupled with the valve rod, and is deformable; wherein the first pressure chamber is located above the second pressure chamber;

the opening is maintained in a closed state by a weight of the valve rod when the pressure sensitive film is not deformed toward the valve rod;

the valve rod includes an end surface; and the pressure control valve further comprises a pressure receiving plate between the pressure sensitive film and the end surface of the valve rod and is larger than the end surface of the valve rod.

2. The pressure control valve according to claim 1, wherein a surface of the pressure sensitive film opposite to the valve rod is exposed to air.

3. The pressure control valve according to claim 1, wherein an inner surface of the first pressure chamber includes a linear protrusion extending in a direction parallel or substantially parallel to an axial direction of the valve rod.

4. A pressure control valve located on a liquid supply path usable to supply a liquid from a liquid supply to a liquid injection head, the pressure control valve comprising:

a housing including an opening that connects a first pressure chamber and a second pressure chamber to each other, and a wall that divides an inner space of the housing into the first pressure chamber and the second pressure chamber in communication with the opening;

an inlet in the housing that communicates with the first pressure chamber;

an outlet in the housing that communicates with the second pressure chamber;

a valve rod that has an outer diameter smaller than an inner diameter of the opening, and a valve that has an outer diameter larger than the inner diameter of the opening and is located in the first pressure chamber; and a pressure sensitive film that is attached to the housing to cover the opening, is coupled with the valve rod, and is deformable; wherein the first pressure chamber is located above the second pressure chamber;

the opening is maintained in a closed state by the valve rod when the pressure sensitive film is not deformed toward the valve rod;

an inner surface of the first pressure chamber includes a linear protrusion extending in a direction parallel or substantially parallel to an axial direction of the valve rod; and the linear protrusion contacts the valve rod and stabilizes the valve rod in a vertical direction.

5. A pressure control valve located on a liquid supply path usable to supply a liquid from a liquid supply to a liquid injection head, the pressure control valve comprising:

a housing including an opening that connects a first pressure chamber and a second pressure chamber to each other, and a wall that divides an inner space of the housing into the first pressure chamber and the second pressure chamber in communication with the opening;

an inlet in the housing that communicates with the first pressure chamber;

an outlet in the housing that communicates with the second pressure chamber;

a valve rod that has an outer diameter smaller than an inner diameter of the opening, and a valve that has an outer diameter larger than the inner diameter of the opening and is located in the first pressure chamber; and a pressure sensitive film that is attached to the housing to cover the opening, is coupled with the valve rod, and is deformable; wherein the first pressure chamber is located above the second pressure chamber;

the opening is maintained in a closed state by the valve rod when the pressure sensitive film is not deformed toward the valve rod;

the valve rod includes an end surface;

the pressure control valve further comprises a pressure receiving plate between the pressure sensitive film and the end surface of the valve rod and is larger than the end surface of the valve rod; and the pressure receiving plate includes a through-hole extending in a radial pattern from a central portion of the pressure receiving plate.

6. The pressure control valve according to claim 5, wherein an inner surface of the first pressure chamber includes a linear protrusion extending in a direction parallel or substantially parallel to an axial direction of the valve rod.

* * * * *